United States Patent [19]

Surdi

[11] Patent Number: 4,604,033

[45] Date of Patent: Aug. 5, 1986

[54] DEVICE FOR LOCKING A TURBINE BLADE TO A ROTOR DISK

[75] Inventor: Jean M. Surdi, Melun, France

[73] Assignee: S.N.E.C.M.A., Evry, France

[21] Appl. No.: 743,599

[22] Filed: Jun. 11, 1985

[30] Foreign Application Priority Data

Jun. 14, 1984 [FR] France ..... 84 09286

[51] Int. Cl.[4] ..... F01D 5/32

[52] U.S. Cl. ..... 416/220 R

[58] Field of Search ..... 416/220 R, 221, 219 R, 416/220 A, 219 A, 222, 218

[56] References Cited

U.S. PATENT DOCUMENTS

| | | | |
|---|---|---|---|
| 3,378,230 | 4/1968 | Toomey | 416/220 R |
| 4,221,542 | 9/1980 | Acres et al. | 416/220 R |
| 4,265,595 | 5/1981 | Bucy, Jr. et. al. | 416/220 R |
| 4,451,205 | 5/1984 | Honda et al. | 416/220 R |
| 4,453,890 | 6/1984 | Brantley | 416/220 R |
| 4,470,756 | 9/1984 | Rigo et al. | 416/220 R |
| 4,474,535 | 10/1984 | Dhuic | 416/220 R |
| 4,478,554 | 10/1984 | Surdi | 416/220 R |
| 4,502,841 | 3/1985 | Kebedjis | 416/220 R |
| 4,527,952 | 7/1985 | Forestier et al. | 416/220 R |

FOREIGN PATENT DOCUMENTS

| | | |
|---|---|---|
| 2345605 | 3/1976 | France . |
| 2492906 | 10/1980 | France . |

*Primary Examiner*—Robert E. Garrett
*Assistant Examiner*—H. Edward
*Attorney, Agent, or Firm*—Bacon & Thomas

[57] ABSTRACT

A device for axially locking a turbine blade onto a rotor disk includes a foot portion of the blade which is slidably retained in a slot provided on the periphery of the rotor disk. An axial projection extends from the foot portion so as to engage a locking ring attached to the rotor disk when the blade is moved in a radially outward direction. A block inserted between the foot portion of the blade and the rotor disk serves to impart such movement to the rotor blade. Brackets on a downstream compressor drum and an upstream cover portion serve to axially lock the block in position.

8 Claims, 6 Drawing Figures

DEVICE FOR LOCKING A TURBINE BLADE TO A ROTOR DISK

FIELD OF THE INVENTION

The present invention relates to means for locking a turbine blade to a rotor disk, particularly such means for use in a turbojet engine.

BRIEF DESCRIPTION OF THE PRIOR ART

French Pat. No. 2,507,679 discloses a device for axially locking a turbine blade into a rotor disk by inserting a block between the rotor disk and the foot of the blade to displace the blade radially outwardly. This displacement causes projecting transverse stop means rigidly attached to the shank or foot of the blade to engage bosses on the rim of the disk so as to prevent any axial displacement of the blade. While this device offers the advantage of allowing the attachment and removal of the blade as individual units, it requires a large number of parts. This requirement may result in one or more of the locks to be inadvertently omitted during assembly, and such omission cannot be checked following the assembly of the device. Also, it requires that teeth be formed on the blade and on the disk, a requirement which is difficult to implement.

Other locking devices are known which make use of collective locking means. However, to remove one of the blades from such assemblies, the full sector must be unlocked. Also, such locking rings formed in sectors impart additional stress to the disk to which they are attached due to the increase in centrifugal forces.

SUMMARY OF THE INVENTION

The present invention remedies these drawbacks of the prior art devices by allowing the individual blades to be assembled and removed from the rotor disk as individual units, while not increasing the centrifugal stress on the rotor disk.

In the present invention, a circular locking ring is mounted on the downstream side of the rotor disk such that inwardly opening notches in the locking ring are aligned with blade slots formed in the periphery of the rotor disk. Each of the blades has a foot portion which is slidably retained in the slot. The foot portion of each of the blades has an axial projection which extends to the downstream side of the disk beyond the locking ring. A block inserted between the foot of the blade and the slot moves the blade radially outwardly such that the axial projection engages the notch in the locking ring so as to axially lock the blade in position.

This device allows a simplified construction of both the rotor disk and the blade by eliminating the teeth required by the prior art devices. In a variation of the invention, it is possible to form the locking ring as an integral part of a downstream portion of the turbine compressor drum, thereby fully minimizing the number of parts of the device.

Using the invention it is possible to combine into the axial projection of the blade foot the radial rest-function absorbing the slot deformations when a blade is lost or broken.

DETAILED DESCRIPTION OF THE PREFERRED EMBODIMENTS

Figure 1:
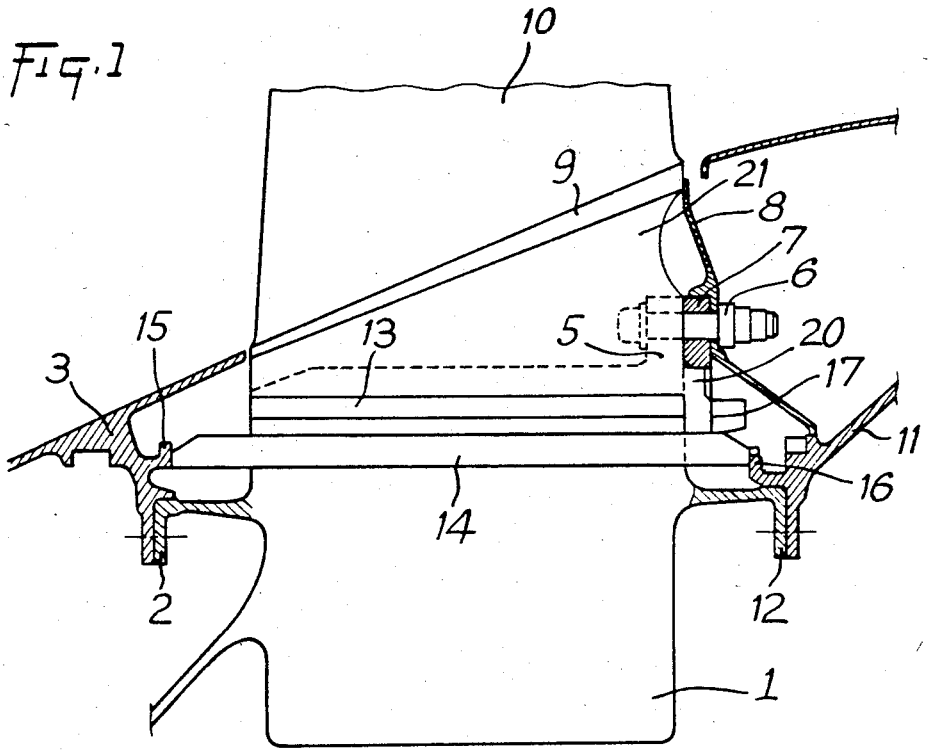
FIG. 1 is a partial, longitudinal sectional view of the turbine blade attachment device according to the invention.
Figure 2:
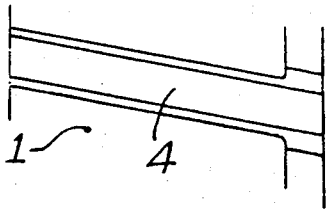
FIG. 2 is a partial top view of the slot formed in the periphery of the rotor disk making an angle of 10° with the engine center line.
Figure 4:
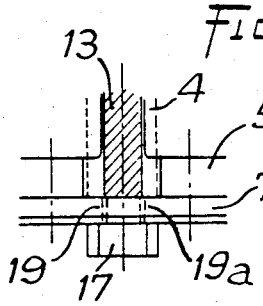
FIG. 4 is a partial plane top view showing the interengagement of the locking ring and down stream portion of the turbine blade foot.

FIG. 1 shows a partial, sectional view of a rotor disk 1 of a turbojet engine rotor having an outer periphery defining a plurality of generally axially extending slots 4 and a bracket 2 extending in an upstream direction to provide attachments for forward cover 3. The slots 4 (see FIG. 2) may extend generally parallel to the central axis of the rotor disk 1 (not shown) about which it rotates, or may be inclined at an angle thereto of approximately 10°. These slots have a dovetail cross-section and may be formed by broaching or similar machining operations.

On its downstream side, rotor disk 1 has radial brackets 5 to which are attached locking ring 7 and sealing ring 8 by means of bolts 6. The radially outermost edge of sealing ring 8 bears against the downstream portion of the turbine blade platform 9 while the radially innermost edge bears against a portion of compressor drum 11. A lower bracket 12, also formed on the downstream side of rotor disk 1, serves as the attachment means for attaching the compressor drum 11 to the rotor disk 1.

Each of the turbine blades 10 have a foot portion 13 also formed with a dovetail shaped cross-section such that they are slidable within the slot 4 of the rotor disk 1. A block 14 inserted between the foot portion 13 and the bottom of the slot 4 serves to displace the blade 10 in a radially outward direction. The block 14 is prevented from moving in an axial direction due to its contact with stop 15 formed on the forward cover portion 3 and bracket 16 formed on compressor drum 11.

The rear of blade foot portion 13 has an axial projection 17 which extends in a downstream direction and engages one of the notches 18 formed in locking ring 7. Notches 18 open in a radially inward direction and are equidistantly spaced about the locking ring 7 such that they are equal to the number of turbine blades and are aligned with the slots 4 formed in rotor disk 1.

Figure 3:
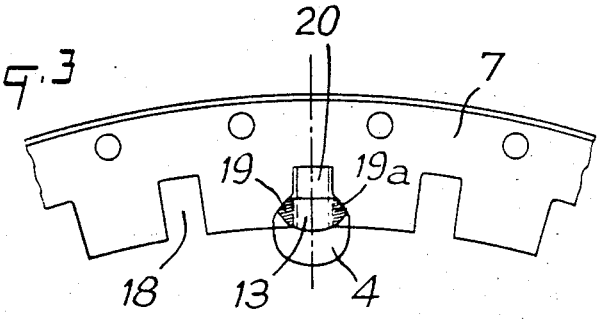
FIG. 3 is a partial rear elevation view of the locking ring according to the invention.
Figure 5:
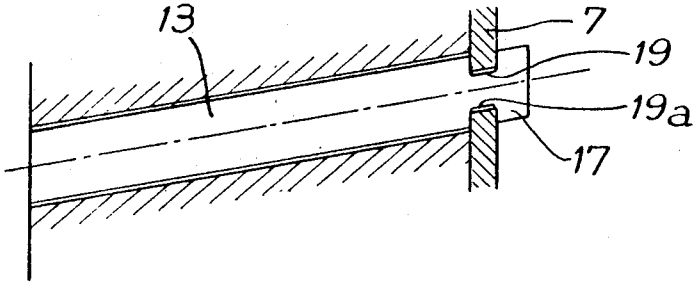
FIG. 5 is a partial, sectional view showing the blade foot and the axial projection engaged with the locking ring.

The sides of axial projection 17 define a pair of opposed recesses 19 and **19*a* as shown in FIGS. 3 and 5. As the turbine blade 10 is moved radially outwardly by the block 14, the recesses 19 and 19*a* engage the sides of notch 18 formed in locking ring 7 so as to axially lock the blade 10 in position. Also, the rear of foot portion 13 also comprises a radial projection 20 which may bear against the bottom of notch 18 to retain the foot portion should the blade 10** become damaged or completely broken off.

To assemble the blades 10 onto the disk 1, the locking ring 7 and sealing ring 8 are first attached to the rotor disk 1 by means of bolts 6. The foot portion 13 of each blade 10 is then slidably inserted into a slot 4 from the upstream side of rotor disk 1 until the axial projection 17 extends beyond locking ring 7. Block 14 is then inserted beneath the foot portion 13 until it contacts bracket 16. This causes foot portion 13 to move radially outwardly such that the upper side of the foot portion 13 is forced against the upper wall of slot 4, and the sides of notch 18 of the locking ring 7 enter the radial recesses 19, 19*a* of the foot portion 13. Finally, the forward cover 3 is mounted onto bracket 2, thereby locking the block 14 in place against the bracket 15.

To remove an individual blade unit 10, the cover 3 and the block 14 are removed to allow axial projection 17 to disengage the locking ring 7. Thereupon the blade 10 can be individually removed from the upstream side of rotor disk 1.

Figure 6:
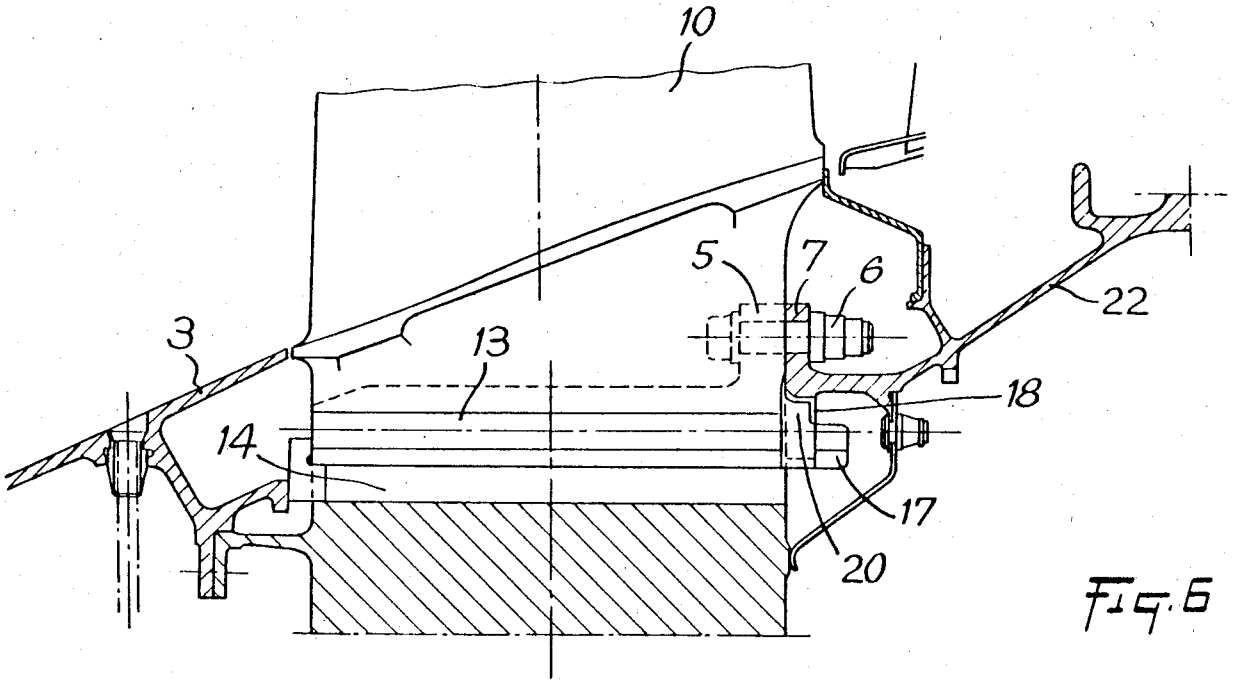
FIG. 6 is partial, longitudinal sectional view showing an alternative embodiment of the locking ring formed as an integral portion of the low pressure compressor drum.

In a second embodiment shown in FIG. 6, the locking ring 7 is formed as an integral portion of downstream compressor drum 22. The notches 18 formed in this locking ring are the same as that shown in the previous embodiment and the functioning of the two embodiments are precisely the same. The foot portion 13 of blade 10 is axially retained due to the engagement of radial recesses 19 and 19*a* with the locking ring 7.

The foregoing descriptions are provided for illustrative purposes only and should not be construed as in any way limiting this invention, the scope of which is defined solely by the appended claims.

What is claimed is:

1. A device for locking a turbine blade to a rotor disk rotatable about a central axis comprising:

(a) a plurality of slots defined by the periphery of the rotor disk, each slot having a base and a dovetail shaped cross-section;

(b) a locking ring defining a plurality of inwardly opening notches;

(c) attachment means to removably attach the locking ring to a downstream side of the rotor disk such that each notch is aligned with a slot;

(d) a foot portion on the turbine blade slidably retained in each slot, the foot portion having an axial projection extending downstream of the rotor disk; and (e) a block inserted between the foot portion of the blade and the base of the slot to move the blade in a radial direction such that the axial projection enters the notch to lock the blade in position on the rotor disk.

2. The device according to claim 1 wherein the width of each notch is less than the width of the axial projection and further comprising a pair of generally radially extending recesses defined by the sides of the axial projection to permit the axial projection to enter the notch.

3. The device according to claim 2 further comprising:

(a) a sealing ring attached to the downstream side of the rotor disk, the sealing ring having a radially outer portion bearing against the downstream side of the turbine blade, and a radially inner portion bearing against a downstream portion of a low pressure compressor drum; and, (b) bolt means to attach the locking ring and the sealing ring to the rotor disk.

4. The device according to claim 2 wherein the locking ring is formed as an integral part of a downstream portion of a low pressure compressor drum, and wherein the attachment means comprises bolt means to attach the locking ring to the rotor disk.

5. The device according to claim 2 wherein each slot extends in a direction generally parallel to the central axis of the rotor disk.

6. The device according to claim 2 wherein each slot extends obliquely to the central axis of the rotor disk.

7. The device according to claim 6 wherein the angle between each slot and the central axis is approximately 10°.

8. The device according to claim 2 wherein the attachment means comprises a plurality of bolt means.

* * * * *